United States Patent [19]

Stageboe et al.

[11] Patent Number: 4,702,648

[45] Date of Patent: Oct. 27, 1987

[54] TENSION LEG PLATFORM

[76] Inventors: Jan Stageboe, Bygdøy alle 66, N-0265 Oslo 2; Erik Gjeruldsen, Havnegaten 5, N-3155 Asgardstrand, both of Norway

[21] Appl. No.: 727,564

[22] Filed: Apr. 26, 1985

[30] Foreign Application Priority Data

Apr. 27, 1984 [NO] Norway ..... 841671

[51] Int. Cl.[4] ..... B63B 35/44; E02B 17/00

[52] U.S. Cl. ..... 405/224; 114/265; 405/205

[58] Field of Search ..... 405/195, 203, 205, 207, 405/208, 211, 224; 114/264, 265

[56] References Cited

U.S. PATENT DOCUMENTS

| | | | |
|---|---|---|---|
| 3,824,943 | 7/1974 | Mo . | |
| 3,982,401 | 9/1976 | Loggins | 405/224 X |
| 4,012,917 | 3/1977 | Gendron | 405/224 X |
| 4,168,673 | 9/1979 | Poeppel | 114/265 |
| 4,169,424 | 10/1979 | Newby et al. | 114/265 |

FOREIGN PATENT DOCUMENTS

| | | | |
|---|---|---|---|
| 2726030 | 12/1977 | Denmark . | |
| 2627658 | 12/1977 | Fed. Rep. of Germany | 405/224 |
| 132753 | 9/1975 | Norway . | |
| 771203 | 10/1978 | Norway . | |
| 771204 | 10/1978 | Norway . | |
| 1102704 | 2/1968 | United Kingdom . | |
| 1287000 | 8/1972 | United Kingdom . | |
| 1444796 | 8/1976 | United Kingdom | 405/224 |
| 1579698 | 11/1980 | United Kingdom . | |

*Primary Examiner*—David H. Corbin

*Attorney, Agent, or Firm*—Cushman, Darby & Cushman

[57] ABSTRACT

A tension leg platform consisting of a platform deck (3) supported by a buoyancy structure (1), a bottom anchoring structure (2) and tension elements (4) extending between the buoyancy structure (1) and the bottom anchoring structure (2). The buoyancy structure (1) comprises a hollow, annular, substantially cylindrical wall forming a can-shaped body having a vertical axis and being fully open at the upper and lower ends, the height as well as the diameter of said body being substantially larger than the thickness of the annular wall in plan view, said wall consisting of closely adjacent, closed, substantially cylindrical, upright concrete cells (5, 7), of which at most half are extended to the platform deck (3) to form supporting shafts (7') therefor.

9 Claims, 9 Drawing Figures

TENSION LEG PLATFORM

BACKGROUND OF THE INVENTION

The present invention relates to a tension leg platform for petroleum recovery on the sea bed, consisting of a platform deck supported by a buoyancy structure, a bottom anchoring structure and tension elements extending between the buoyancy structure and the bottom anchoring structure.

The buoyancy of such a platform exceeds its weight by a margin termed the excess buoyancy, which maintains the tension elements in tension. Tension leg platforms have been described in U.S. Pat. No. 3,648,638, GB patent specification No. 1.337.601 and GB Patent Specification No. 1.462.401.

The tension suppresses movement in a vertical plane, that is roll, pitch and heave, but only to a limited extent acts as a restoring force to reduce movement in a horizontal plane.

Where a platform is used for oil production from an underwater well, it is desirable to be able further to reduce the horizontal movement of the platform in relation to the well, for instance to facilitate the making of pipe, particularly riser, connections and to prevent damage thereto.

Generally, it is an object to provide the least possible movement in a seaway, and particularly to reduce the horizontal movement of the platform.

According to GB patent specification No. 1.462.401 this is achieved by means of thrusters. FIG. 1 of this patent specification illustrates a traditional tension leg platform in which the main buoyancy is provided by shafts which are only interconnected by means of bracings to provide sufficient strength. In order to illustrate that thrusters can be used irrespective of the shape of the buoyancy structure FIGS. 2 and 3 of the GB patent specification No. 1.462.401 show further suggested designs of the buoyancy structure. However, these designs are believed to be purely theoretical desk designs which will not function in practice.

It has also been suggested to position the shafts providing the main buoyancy rather close together and to connect them by means of upright cylindrical cells which fill the space between the shafts. The required stability is obtained by extending the shafts further down into the water in order to form a ballast structure.

SUMMARY OF THE INVENTION

According to the present invention a quite different approach from those described in the two preceding paragraphs has been chosen. The concept behind the present invention is to let the buoyancy structure surround a very large amount of water having a mass of the same order as that of the buoyancy structure, the buoyancy structure being designed so as to prevent horizontal movement between the surrounded water mass and the buoyancy structure without unduly obstructing the vertical movement therebetween. Thereby, the water mass will increase the inertia of the platform with respect to rolling and other movements having a horizontal component, while being allowed to fluctuate vertically corresponding to the wave movements without substantially influencing the platform. This concept is not disclosed in any of the publications referred to above or in any other publications known to the applicants.

This concept has been materialized in a tension leg platform wherein the buoyancy structure comprises a hollow, annular, substantially cylindrical wall forming a can-shaped body having a vertical axis and being fully open at the upper and lower ends, the height as well as the diameter of said body being substantially larger than the thickness of the annular wall in plan view, said wall consisting of closely adjacent, closed, substantially cylindrical, upright concrete cells, of which at most half are extended to the platform deck to form supporting shafts therefor.

Each of the cells of the buoyancy structure may suitably comprise a substantially circular-cylindrical wall, a roof and a bottom, at least one of said roof and bottom having a planar, domed or conical shape.

In a tension leg platform of the type discussed having a bottom anchoring structure which is anchored by gravity, the anchoring structure may comprise substantially cylindrical upright concrete cells similar to the cells of the buoyancy structure, a number of said anchoring structure cells corresponding to the number of shafts being vertically aligned with one each of the shaft-forming extended cells and forming an anchor for tension elements each extending between one of said number of cells and the respective aligned cell of the buoyancy structure. Thereby, the tension elements will extend vertically and parallelly between the buoyancy structure and the anchoring structure. The tension elements may consist of wrought steel tubing, steel bars or steel cables.

The annular cylindrical wall of the buoyancy structure according to the invention may conveniently consist of eight to sixteen vertical cells, of which three or four are extended to the platform deck to form supporting shafts therefor.

SHORT DESCRIPTION OF THE DRAWINGS

The platform according to the invention will now be further described with reference to the drawings, which illustrate two embodiments of the platform.

FIG. 1 is a diagrammatical side view of an embodiment having a bottom anchoring structure anchored by gravity.

FIGS. 2 A to C are diagrammatical sectional views along the lines 2A—2A, 2B—2B and 2C—2C, respectively, in FIG. 1.

Figure 4:
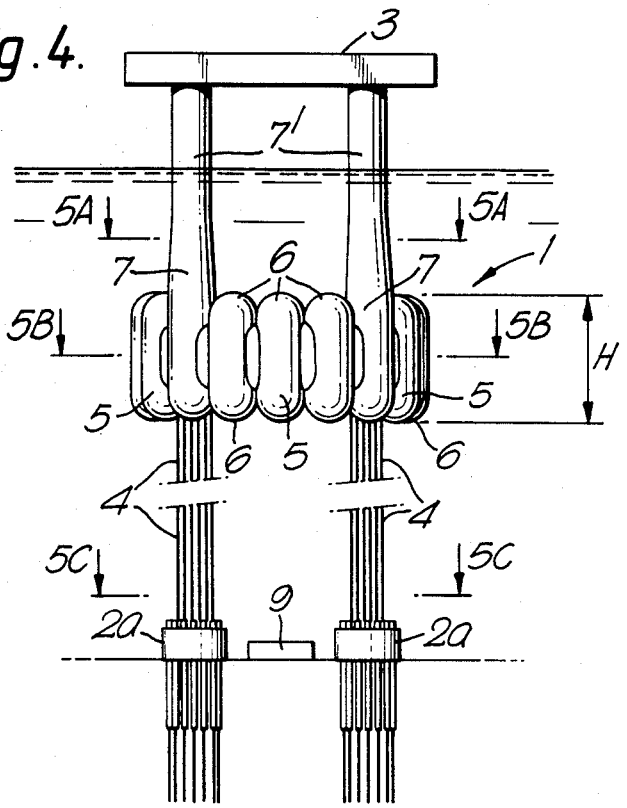
FIG. 4 is a side view of an embodiment in which the anchoring structure is anchored by piling.
Figure 5A:
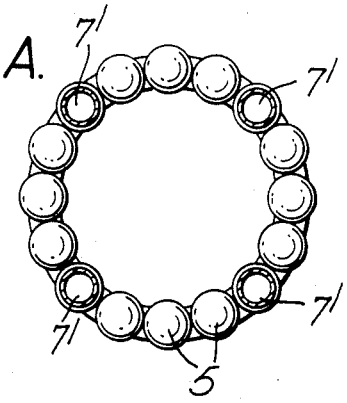
Figure 5B:
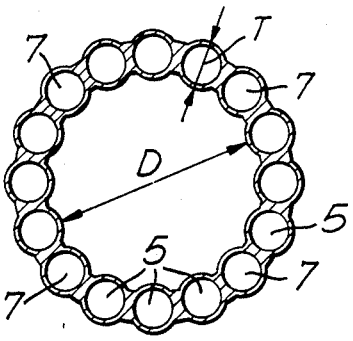
Figure 5C:
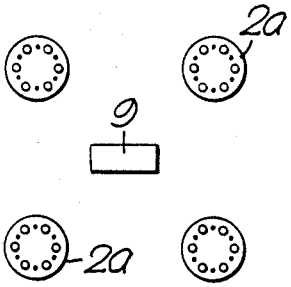

FIGS. 5 A to C are sectional views along the lines 5A—5A, 5B—5B and 5C—5C, respectively, in FIG. 4.

DETAILED DESCRIPTION OF PREFERRED EMBODIMENTS

Figure 1:
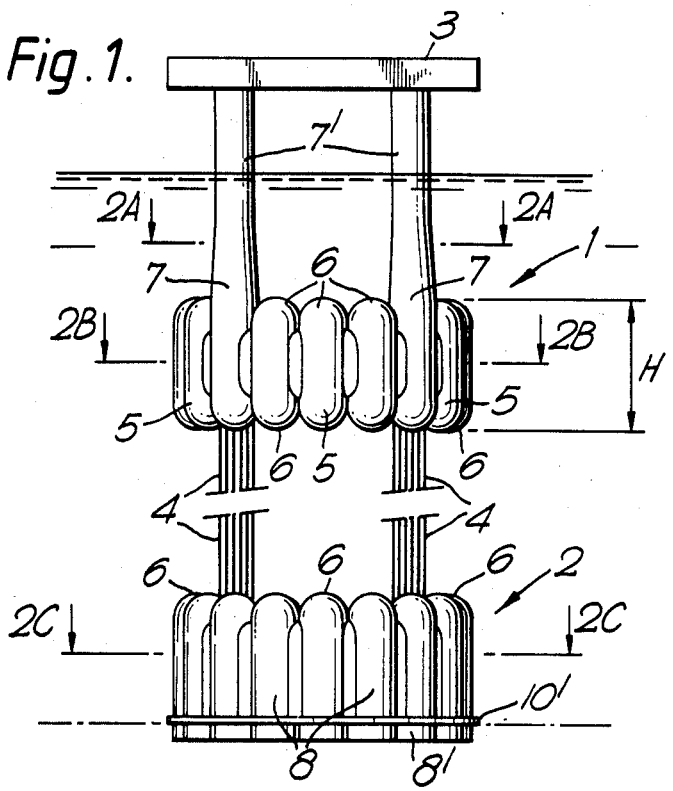
Figure 2A:
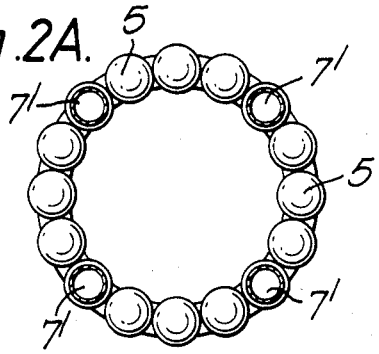
Figure 2B:
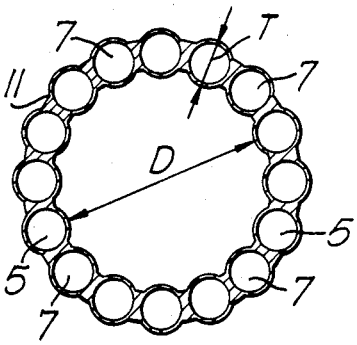

In both of the illustrated embodiments a buoyancy structure 1 consists of a hollow, annular, substantially cylindrical wall 11 forming a can-shaped body having a vertical axis and being fully open at the upper and lower ends. The height H of said wall is indicated in FIG. 1 and its inner diameter D is indicated in FIG. 2B, and both these dimensions are substantially larger than the wall thickness T indicated in FIG. 2B. As illustrated in the drawing, the wall 11 consists of closely adjacent, closed, substantially cylindrical, upright concrete cells 5 and 7, the numeral 5 designating cells having only the height H of the wall 11, whereas the cells 7 are extended to a platform deck 3 to form supporting shafts 7′ therefor.

The annular shape of the wall 1 does not have to be circular. It can also be polygonal, including triangular and rectangular. It is important, however, that the wall is truly annular, i.e. fully closed in plan view, so as totally to surround a large amount of water having a mass of substantially the same order as that of the buoyancy structure.

The buoyancy structure 1 is manufactured of reinforced concrete according to the concrete casting technology that is conventional in the field of platform casting. FIG. 1 illustrates the generally cylindrical cells 5 which all have semispherical tops and bottoms, and the extended cells 7 having only semispherical bottoms, the top extensions of the cells forming shafts 7′. Because of the suitable manufacturing process of casting by means of a sliding shuttering a cylindrical shape of the cells 5 and 7 will be most convenient, except for end sections and transitions. Both from a structural point of view and from a production point of view it will be most advantageous to use circular-cylindrical shapes having generatrices extending parallel to the axis, but it should be obvious that the cells can have any rotational-symmetrical shape.

Thus, the buoyancy structure is constituted by vertical cylindrical cells 5 and 7 lying closely adjacent and being connected so that their vertical outer sides form continuous outer and inner cylindrical surfaces, so as generally to form a hollow body. The top of the generally cylindrical cells may lie 20 to 50 m below the water surface, and their height may be approximately 20 l to 50 m, whereas the largest horizontal dimension across the circular or polygonal annulus formed by the cells may be 40 to 70 m.

The extended cells 7 and/or the shafts 7′ formed thereby may have a diameter different from that of the remaining cells 5 of the buoyancy structure 1. Especially, the cells 7 and the shafts 7′ may have the same diameter, which may be larger than the diameter of the remaining cells 5.

The platform deck 3 is highly diagrammatically shown in the Figures. It will usually not be part of the concrete structure, but will instead, because of circumstances related to the weight distribution and the equipment provided on the deck, usually be made of steel and mounted on the top of the shafts 7′ when the platform has been lowered into position on site. Equipment for drilling and/or production may be lowered or raised from the platform deck 3 through the annular wall 11 formed by the cells 5 and 7.

Figure 2C:
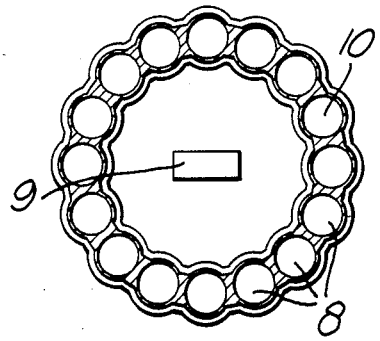
Figure 3:
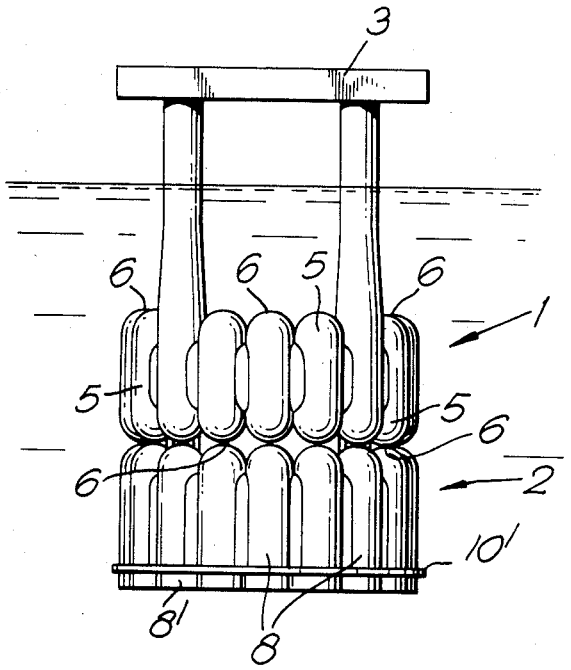
FIG. 3 is a side view of the platform showing the anchoring structure suspended from the buoyancy structure to allow towing in shallow waters.

In the embodiment illustrated in FIGS. 1 to 3 the bottom anchoring structure 2 comprises substantially cylindrical, upright concrete cells 8, similar to the cells 5 of the buoyancy structure 1. Said cells 8 may be closely adjacent and form a configuration corresponding to that formed by the cells 5 and 7 of the buoyancy structure 1. In fact, a number of said anchoring structure cells 8 corresponding to the number of shafts 7′ are vertically aligned with one each of the shaft-forming extended cells 7 and form anchors for tension elements 4 each extending between one of said number of cells 8 and the respective aligned cell 7 of the buoyancy structure. It is not essential that the remaining cells 8 are vertically aligned with the cells 5 of the buoyancy structure. Thus, the anchoring structure 2 may have configuration different from that of the buoyancy structure 1, provided that cells 8 forming anchors for the tension elements are aligned with the extended cells 7.

The sectional views of FIG. 2 illustrate the preferred circular configuration of the cells 5 and 7 of the buoyancy structure 1 and the cells 8 of the anchoring structure 2.

The anchoring structure cells 8 surround a drilling frame or template 9 intended to be positioned on the sea bed before or after positioning of the anchoring structure. Alternatively, the template 9 may be mounted in the anchoring structure. The anchoring structure cells 8 may be designed in the same way as the cells 5, i.e. they may comprise a substantially circular-cylindrical wall, a roof and a bottom, at least one of said roof and bottom having a planar, domed or conical shape. The bottom of said anchoring structure cells may form a bottom plate 10 which will be planar or bulged according to the shape of the bottom of the cells. Said bottom plate 10 can be extended beyond (inside and/or outside) the annular wall of the anchoring structure 2 to form a collar 10′ providing an improved support of the anchoring structure 2 and permitting anchoring by piling.

The bottom anchoring structure 2 is intended to be placed on the bottom of the sea, the cells 8 being partly filled with water and/or a heavier material. As illustrated in FIG. 2A also the cells 8 of the anchoring structure 2 have semispherical tops. The bottoms may also be semispherical and combined with a collar 10′ or they may alternatively form a planar bottom plate 10 for the cells 8.

The walls of the anchoring structure cells 8 are extended below the bottom plate 10 to form a skirt 8′ for penetration into the sea bed. Alternatively, the bottom plate 10 can in a conventional manner be provided with a skirt of steel or concrete for better anchoring.

The method of installation of the concrete anchoring structure 2 may include suspending the anchoring structure 2 below the buoyancy structure 1, towing it to the site and lowering the anchoring structure to the bottom of the sea. Alternatively, the anchoring structure 2 including a template 9 may be positioned in advance for predrilling from a drilling rig.

During the lowering of the anchoring structure the hydrostatic pressure, which on large depths may be rather high, can be fully or partially balanced by means of a supply of pressurized air.

The anchoring structure cells 8 may be used for storing oil or gas. Alternatively, they may be flooded or filled with other ballast contributing to the anchoring of the structure 2 by gravity. According to another embodiment the anchoring structure cells 8 or at least some of these cells may contain equipment for drilling and/or production as well as connectors for pipelines and risers. These connectors may be dry connectors, i.e. connectors surrounded by a dry atmosphere.

The tensioning elements 4 extending between the buoyancy structure 1 and the anchoring structure 2 are passed through the bottom of the extended cells 7 and uniformly distributed and anchored in the cells 7 or the shafts 7′.

The tensioning elements 4 are intended to extend vertically or approximately vertically between the buoyancy structure 1 and the bottom anchoring structure 2, whether this anchoring structure is a gravity anchoring structure as shown in FIGS. 1 to 3, or a structure 2*a* anchored by means of piling as diagrammatically illustrated in FIGS. 4 and 5. Traditional piling technique may be used, and it should therefore be superfluous to describe the piling operation in more detail.

In tension leg platform structures of the type to which the invention relates, the tension elements will be provided with devices for limiting and monitoring the forces therein and for absorbing forces and accommodating movements of the buoyancy structure which under special conditions (waves/winds/current/blowout) are not elastically absorbed directly in the tension elements. Tube elements or compact bars of wrought iron with threaded joints may easily be joined lengthwise. However, the choice between tubing, compact bars or cable bunches having parallel chords, will depend on the technical development and follow this development.

The production may take place from underwater completed wells through pipelines and risers to the platform or by platform completed wells. In the latter case the wells may be drilled either before installation of the production platform or direct therefrom after installation.

The main advantages of the platform according to the invention are:

Due to the use of concrete there is lack of corrosion and fatigue. The maintenance is minimal and construction is easy. The hull is economical since the unit cost (cost per unit of displaced volume) of concrete is very much lower than that of steel.

The increased displacement even has the advantage of reducing considerably the weight sensitivity of the platform, which is considered a serious problem for tension leg platforms. The large displacement has not led to technological problems such as very large tension element or anchor leg forces. On the contrary, the improved shape of the hull results in very modest wave induced tension element forces, in spite of the large platform displacement and the increased stability with respect to horizontal movements. It is the extraordinarily good dynamic behaviour of the platform that results in small dynamic tension element or anchor leg forces.

The varying draft of the platform has almost no influence on the fluctuating force in the tension elements, and the direct wave and wind induced force components are small. Consequently, the pretension level may be chosen within wide limits.

What we claim is:

1. A tension leg platform structure for petroleum recovery on the sea bed, comprising a platform deck supported by a buoyancy structure, a bottom anchoring structure which is anchored by gravity, and tension elements extending between said buoyancy structure and said bottom anchoring structure, said buoyancy structure comprising hollow deck-supporting shafts, wherein said anchoring structure comprises an annular array of closely adjacent, substantially cylindrical, upright, closed concrete cells, a number of which corresponding to the number of shafts being vertically aligned with a respective one of said shafts and forming anchors for said tension elements, each of said tension elements extending vertically between one of said cells and the respective aligned shaft of said buoyancy structure.

2. A tension leg platform structure acording to claim 1 comprises a hollow, annular, substantially cylindrical wall forming a can-shaped body having a vertical axis and being fully open at the upper and lower ends, the height as well as the diameter of said body being substantially larger than the thickness of the annular wall in plan view, said wall consisting of closely adjacent, closed, substantially cylindrical, upright, concrete cells of which at most half are extended to the platform deck to form the supporting shafts therefor.

3. Tension leg platform according to claim 1, wherein each of the cells of the buoyancy structure. comprises a substantially circular-cylindrical wall, a roof and a bottom, at least one of said roof and bottom having a planar, domed or conical shape.

4. Tension leg platform as claimed in claim 1, wherein the anchoring structure cells surround a drilling frame or template intended to be positioned on the sea bed before or after positioning of the anchoring structure or being mounted in the anchoring structure.

5. Tension leg platform as claimed in claim 1, wherein each of said anchoring structure cells comprises a substantially circular-cylindrical wall, a roof and a bottom, at least one of said roof and bottom having a planar, domed or conical shape.

6. Tension leg platform as claimed in claim 5, wherein the bottoms of said anchoring structure cells form a bottom plate extending beyond the annular wall of the anchoring structure to form a collar providing an improved support of the anchoring structure and permitting anchoring by piling.

7. Tension leg platform as claimed in claim 6, wherein the walls of the anchoring structure cells are extended below the bottom plate to form a skirt for penetration into the sea bed.

8. Platform structure according to claim 1 wherein the buoyancy structure includes an annular array of closely adjacent, substantially cylindrical upright closed cells, some of which are extended upward to form said shafts.

9. Tension leg platform as claimed in claim 8, wherein four out of eight to sixteen buoyancy structure cells are extended to the platform deck to form shafts.

* * * * *